US007652590B2

(12) United States Patent
Lin

(10) Patent No.: US 7,652,590 B2
(45) Date of Patent: Jan. 26, 2010

(54) THIN EMERGENCY EXIT INDICATION AND WARNING DEVICE

(76) Inventor: Yuan Lin, 5 Viewmont Court, Doncaster East, 3109 VIC. (AU)

( * ) Notice: Subject to any disclaimer, the term of this patent is extended or adjusted under 35 U.S.C. 154(b) by 0 days.

(21) Appl. No.: 11/649,886

(22) Filed: Jan. 5, 2007

(65) Prior Publication Data

US 2008/0164981 A1 Jul. 10, 2008

(51) Int. Cl.
*G08B 5/22* (2006.01)

(52) U.S. Cl. ..... 340/815.45

(58) Field of Classification Search ..... 340/815.45, 340/326, 332, 693.2; 362/234, 368
See application file for complete search history.

(56) References Cited

U.S. PATENT DOCUMENTS 6,472,994 B1 * 10/2002 Tator ..... 340/815.4
7,255,454 B2 * 8/2007 Peterson ..... 362/147
7,339,488 B2 * 3/2008 Pennington et al. ..... 340/691.1
7,378,989 B2 * 5/2008 Wisch et al. ..... 340/981

FOREIGN PATENT DOCUMENTS

TW 590193 6/2004
TW M280515 11/2005

* cited by examiner

*Primary Examiner*—Phung Nguyen
(74) *Attorney, Agent, or Firm*—Guice Patents PLLC

(57) ABSTRACT

A thin indication and warning device includes one or more self-powered indicator units 1 adapted to assemble together by means of a connector 2. The indicator unit 1 includes a channel member 11 including a recessed base 111 and a cover 112 including openings 115; light indicators 12 each including a housing 121 aligned with the opening 115, and a light-emitting member 122 mounted under the housing 121; a control circuit 14; and a rechargeable power supply 13. In response to power outage an abnormal voltage detection circuit 126 detects same and sends an activation signal to the power supply 13, the enabled power supply 13 supplies power to an alarm circuit 143 and each light indicator 12 respectively, the enabled alarm circuit 143 makes a warning sound, and each light indicator 12 emits light for indication.

13 Claims, 6 Drawing Sheets

THIN EMERGENCY EXIT INDICATION AND WARNING DEVICE

BACKGROUND OF THE INVENTION

1. Field of Invention

The present invention relates to emergency exit indication equipment and more particularly to a highly adaptable thin device having one or more units connected together, each unit having an independent emergency power for enabling the unit to visually indicate and audibly warn trapped people to escape from a building where, for example, a fire has occurred.

2. Description of Related Art

For safety reasons, exit lights are required to mount in a building. These exit lights are aimed at helping persons escape by following the indication signs in case of emergency (e.g., fire, earthquake, or the like).

There have been numerous suggestions in prior patents for emergency exit indication devices. For example, Taiwanese Utility Model Publication No. 590,193 discloses an emergency exit light either fixedly mounted on a recess of wall or hanged thereon. The exit light typically has an elevation of about at least two (2) meter above the floor for preventing the head of an ordinary person from colliding while walking or running. It is understood that in case of fire the best way for a trapped person leaving the scene is either lowering his or her body while running or walking or crawling. Also, smoke rises by nature. Hence, smoke can completely block the view of the trapped person. As a result, the desired function of directing trapped persons to leave the fire scene is compromised.

Another Taiwanese Utility Model Patent No. M280,515 discloses an optoelectric emergency exit light. It comprises a base, a LED (light-emitting diode) mounted on the base, and an indication sign. The LED will emit light when, for example, a fire occurs. However, the patent suffers a number of drawbacks the same as that described above.

Still, there is a strip shaped emergency exit light commercially available. It comprises a plurality of light-emitting elements connected in series as indication sign, and a circuit adapted to cause the light-emitting elements to flash in case of, for example, fire. However, the elongate exit light is not allowed to customize. Thus, its applications are very limited.

Moreover, any above prior art suffered from a number of common disadvantages. First, it is relatively bulky and it is thus difficult of mounting on a lower portion of a wall, a corner, or on a floor. Second, it is a light based device. Thus, it is useless for blind persons. Third, it is powered by a single rechargeable battery. Thus, the desired function of directing trapped persons to leave in case of emergency is compromised if the battery is damaged. Thus, continuing improvements in the exploitation of emergency exit indication and warning device are constantly being sought.

SUMMARY OF THE INVENTION

It is therefore one object of the present invention to provide a highly adaptable thin device having one or more units flexibly connected together, each unit having an independent emergency power for enabling the unit to visually indicate and audibly warn trapped people to escape from a building where, for example, a fire has occurred.

To achieve the above and other objects, the present invention provides a device for visually indicating and audibly warning people to escape from a building in case of emergency, comprising one or more thin indicator units each including a channel member including a base and a cover fitted on the base, the cover including a plurality of openings;

a plurality of light indicators electrically connected together and each including a housing aligned with the opening, and a light-emitting member mounted in the housing; a control circuit electrically connected to the light indicator at one end of the indicator unit; a first pair of prongs at one end of the control circuit; a second pair of prongs at the other end of the light indicator at the other end of the indicator unit; and a rechargeable power supply mounted on the base and electrically connected to the control circuit; and one or more electrical connectors each including opposite first and second portions electrically connected together, wherein the first portion of one electrical connector is adapted to electrically connect to the first pair of prongs, and the second portion of the other electrical connector is adapted to electrically connect to the second pair of prongs.

In one aspect of the present invention each of the first and second portions comprises two receptacles sealed by a waterproof membrane and adapted to receive the prongs of the same pair by inserting the prongs of the same pair through the membrane.

In another aspect of the present invention the control circuit comprises a processor unit electrically connected to the adjacent light-emitting member and the abnormal voltage detection circuit respectively; a battery current monitoring and charging circuit electrically connected to the processor unit and the power supply respectively, the battery current monitoring and charging circuit adapted to monitor remaining current of the power supply and adapted to charge the power supply if the amount of current in the power supply is lower than a predetermined level, wherein the battery current monitoring and charging circuit causes the control circuit and each light-emitting member to enter into an off-but-ready mode after charging; and an alarm circuit electrically connected to and enabled by the abnormal voltage detection circuit, wherein in response to power outage the abnormal voltage detection circuit detects same and sends an activation signal to the power supply, the enabled power supply supplies power to the alarm circuit and each light indicator respectively, the enabled alarm circuit makes a warning sound, and each light indicator emits light for indication.

The above and other objects, features and advantages of the present invention will become apparent from the following detailed description taken with the accompanying drawings.

DETAILED DESCRIPTION OF THE INVENTION

Figure 1:
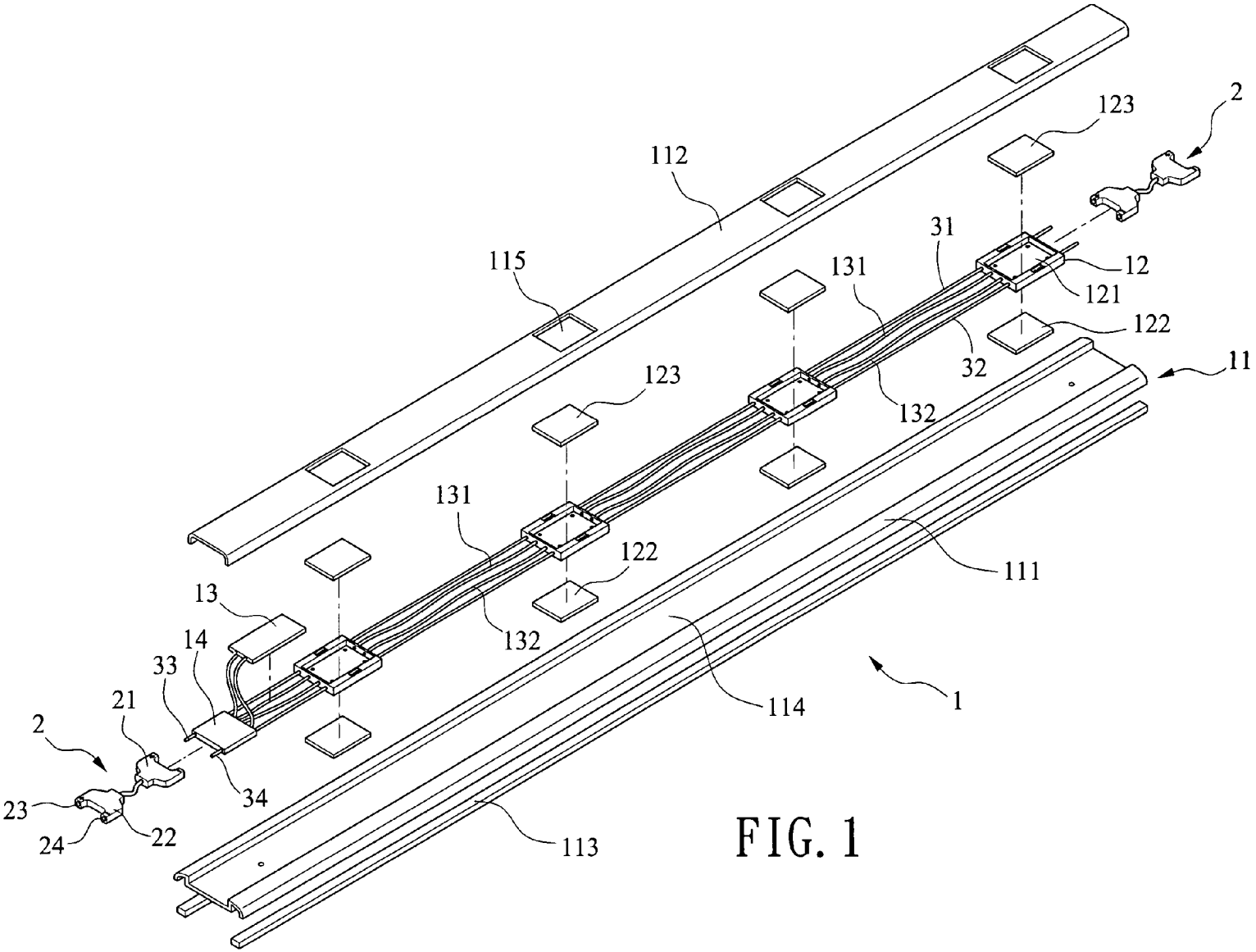
FIG. 1 is an exploded perspective view of a preferred embodiment of emergency exit indication and warning device according to the invention.

Referring to FIGS. 1 to 3 and FIG. 6, an emergency exit indication and warning device in accordance with a preferred embodiment of the invention comprises at least one thin indicator unit 1 each adapted to assemble with another indicator unit 1 by means of an electrical connector 2. That is, the length of the device is not fixed so as to be customized. Each indicator unit 1 comprises a channel member 11, an independent power supply (e.g., a rechargeable battery) 13, a plurality of light indicators 12, and a control circuit 14. Each component is discussed in detailed below.

The elongate channel member 11 comprises a base 111 including a central lengthwise top recess 114 for mounting the light indicators 12, the power supply 13, and the control circuit 14 thereon, and two parallel metal spacer members 113 mounted in two side grooves of the base 111; and an elongate cover 112 snappingly mounted on the recess 114 by means of projections (not shown) and apertures (not shown), the cover 112 including a plurality of spaced, rectangular openings 115.

The light indicators 12 are aligned with the openings 115. Two adjacent light indicators 12 are electrically connected together by means of two pairs of wires 31 and 32. Also, the control circuit 14 is electrically connected to the light indicator 12 at one end of the indicator unit 1 by means of the pairs of wires 31 and 32. One set of first and second prongs 33 and 34 are formed at one end of the control circuit 14. Further, another set of first and second prongs 33 and 34 are formed at the other end of the light indicator 12 at the other end of the indicator unit 1. The rectangular light indicator 12 comprises a rectangular recess housing 121, a rectangular light-emitting member 122 mounted in the opening 121, and a transparent, rectangular protection member 123 mounted on the opening 121 and snugly disposed in the opening 115. Preferably, the protection member 123 is made of reinforced glass, impact-proof material or the like.

Figure 6:
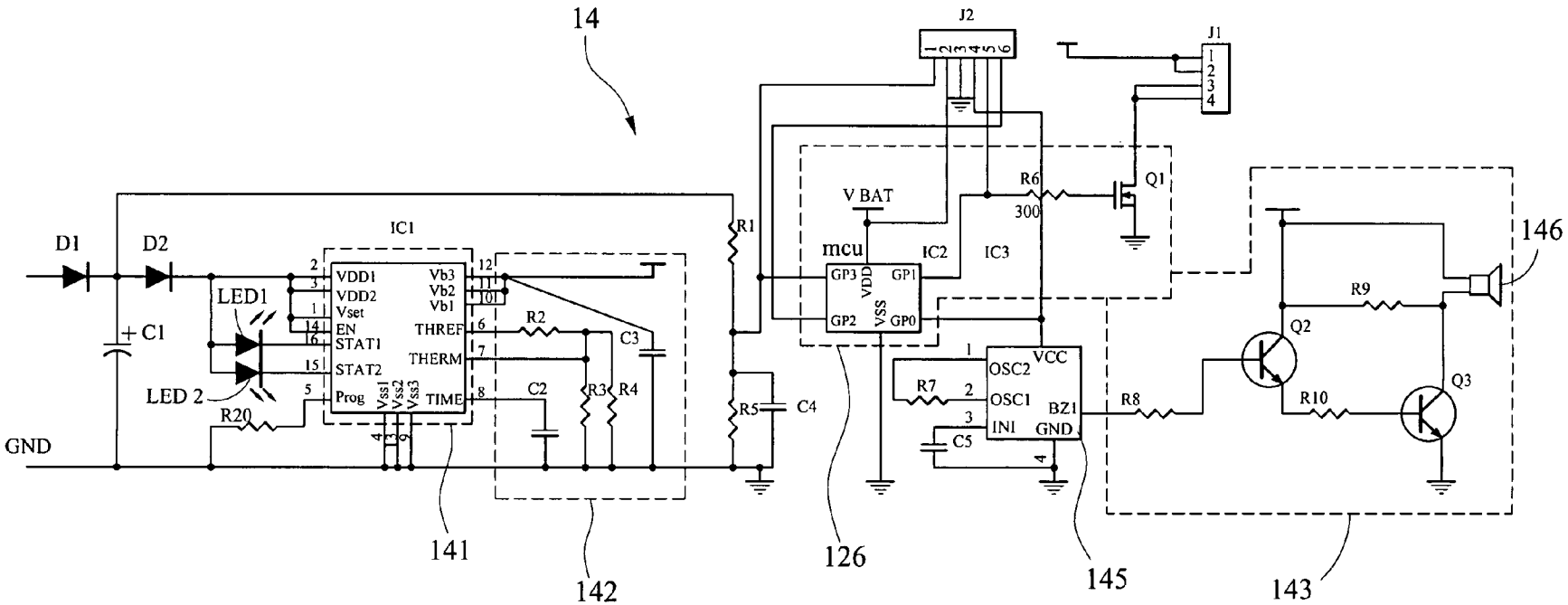
FIG. 6 is a circuit diagram of the control circuit of the device.

As shown in FIG. 6, the light-emitting member 122 is implemented as a LED assembly including a first LED1 adapted to emit light rays of single color, and a second LED2 adapted to emit light rays of two different colors. Alternatively, the light-emitting member 122 is implemented as a LED adapted to emit light rays of two or more different colors. Also, the light-emitting member 122 is mounted on a circuit board having an abnormal voltage detection circuit 126.

The light indicator 12 is aimed at indication. Particularly, the color LED of the light indicator 12 is adapted to indicate the charging state of the power supply 13. The LED of the light indicator 12 is implemented as a SMD (surface mounting) LED or COB (chip on board) LED. Thus, its height can be made no more than 6 mm, i.e., very thin.

The power supply 13 is electrically connected to the control circuit 14 for supplying power to the control circuit 14 and the light indicators 12 in a normal state. The power supply 13 is rechargeable. The control circuit 14 can activate the power supply 13 in case of power outage due to, for example fire. It is envisaged by the invention that the operation of one indicator unit 1 is totally independent of the other indicator unit 1. That is, one malfunctioned indicator unit 1 will not adversely affect the operation of any other indicator unit 1. Further, the device of the invention can be made of any desired number of units 1. Thus, its application is not limited. In a normal state, the control circuit 14 is adapted to monitor remaining current of the power supply 13 and is adapted to permit a charging of the power supply 13 if such condition arises.

Figures 2, 2A:
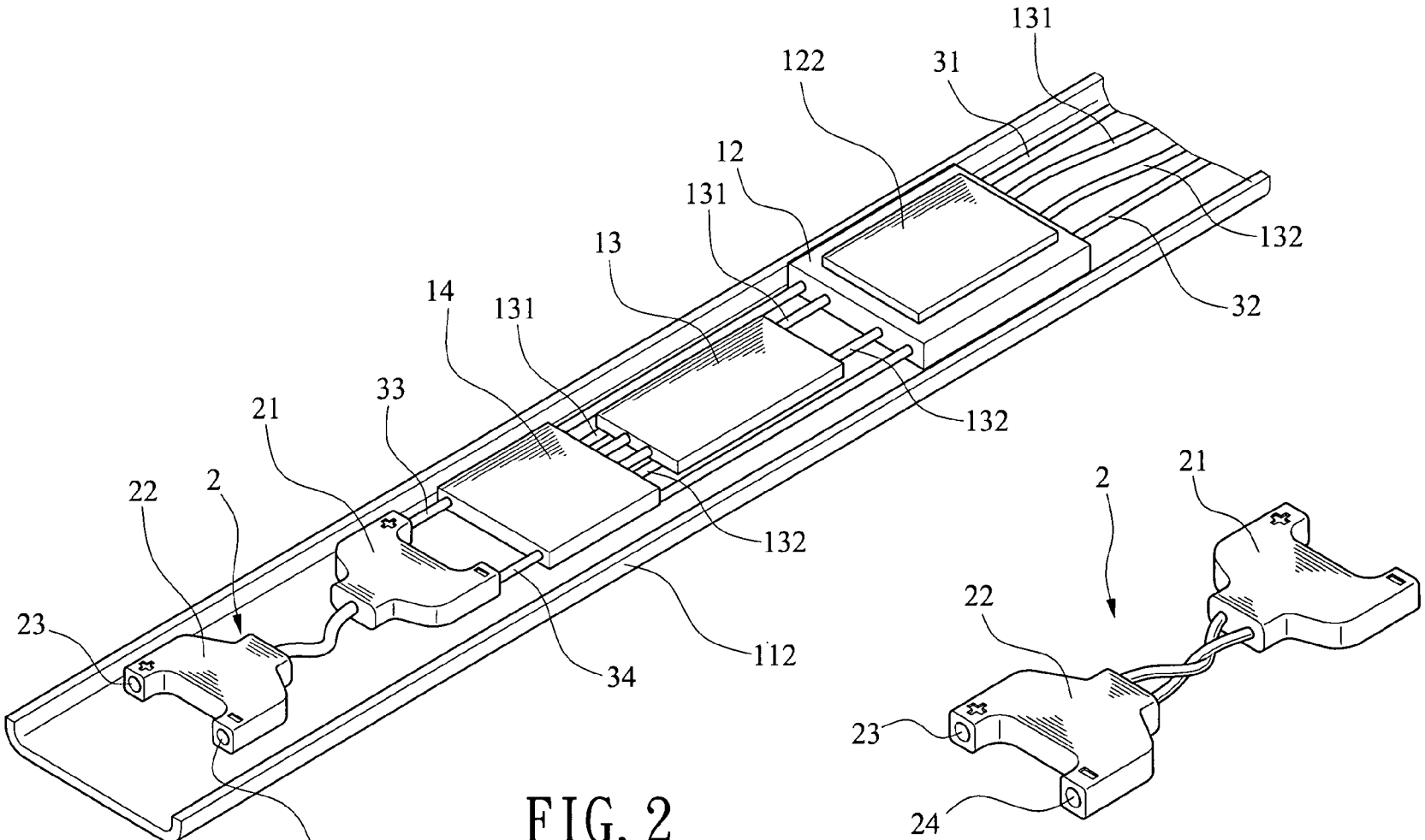
FIG. 2 is a perspective view of the assembled device.
FIG. 2A is a perspective view of another configuration of the electrical connector.
Figure 3:
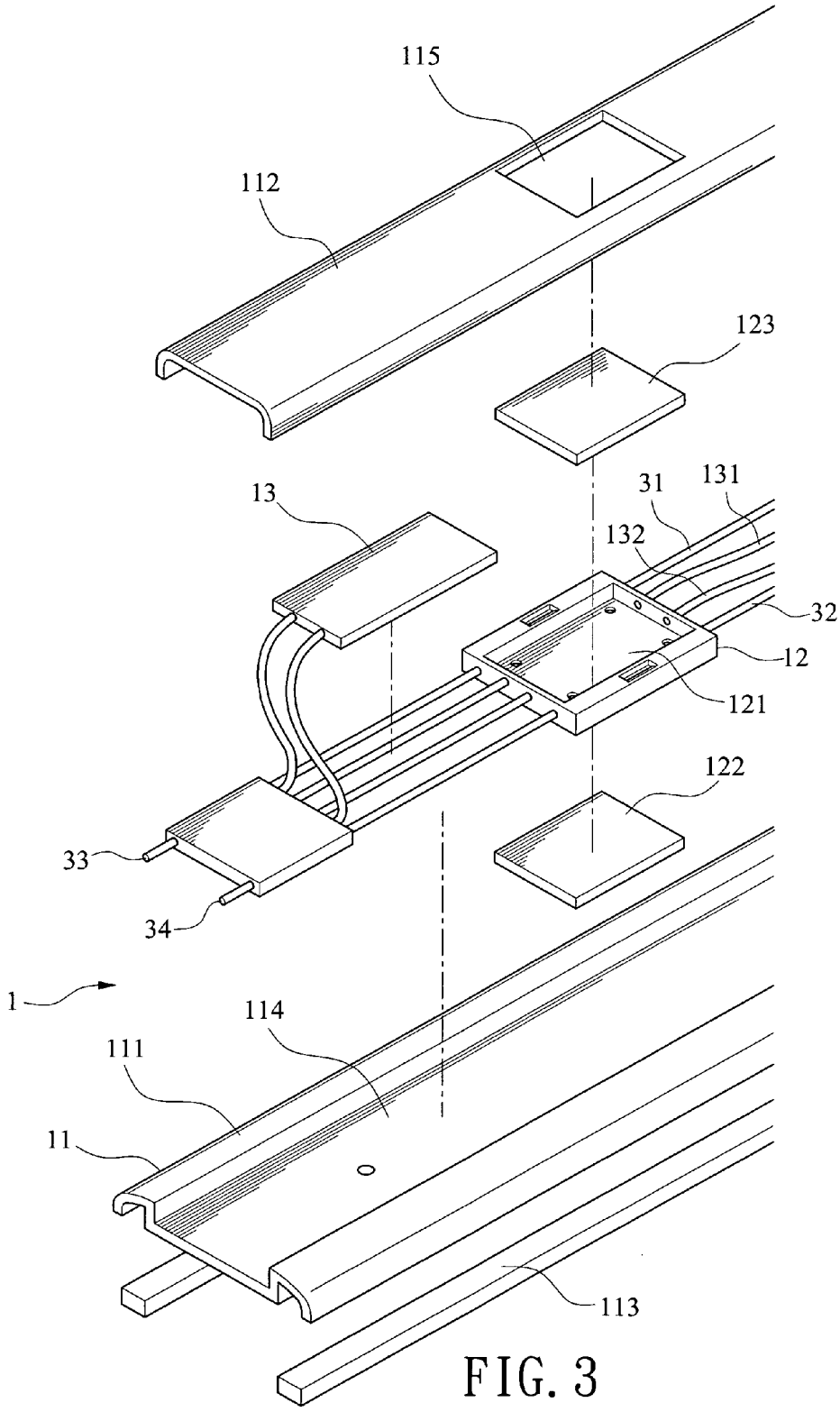
FIG. 3 is a greatly enlarged view of a portion of FIG. 1.

As shown in FIG. 2, the connector 2 comprises two opposite portions 21 and 22 electrically connected together. Either portion 21 or 22 has two receptacles 23 and 24 adapted to receive the prongs 33 and 34 at either end of one indicator unit 1 by insertion. The prongs 33 and 34 at either end of one indicator unit 1 are either directly connected to an external power source (not shown) or indirectly connected to the external power source via the electrical connector 2 and/or a power cord for obtaining power therefrom. In such a manner, the units 1 can be assembled together as a desired emergency exit indication and warning device. Preferably, each of the receptacles 23 and 24 has its mouth sealed by means of a waterproof membrane prior to assembly. As shown in FIGS. 2 and 2A, the connection between the portions 21 and 22 is flexible so as to be adapted to a specific application.

Figure 4A:
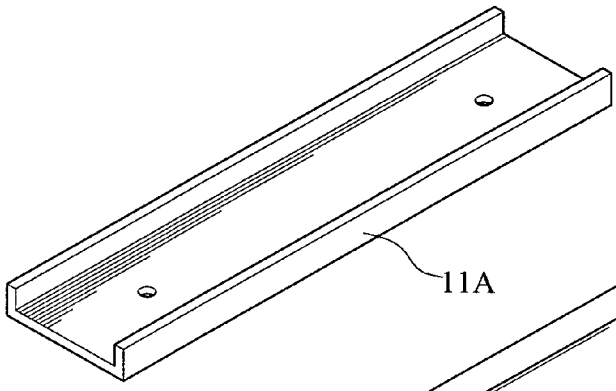
FIG. 4A to 4D are perspective views of first, second, third, and fourth configurations of the channel member.
Figure 4B:
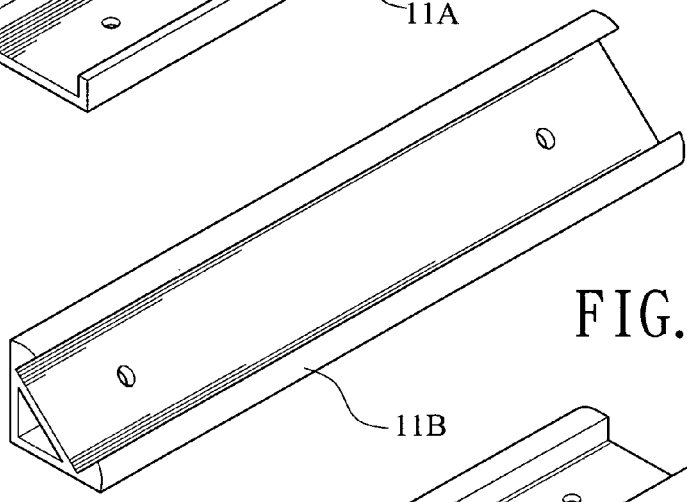
Figure 4C:
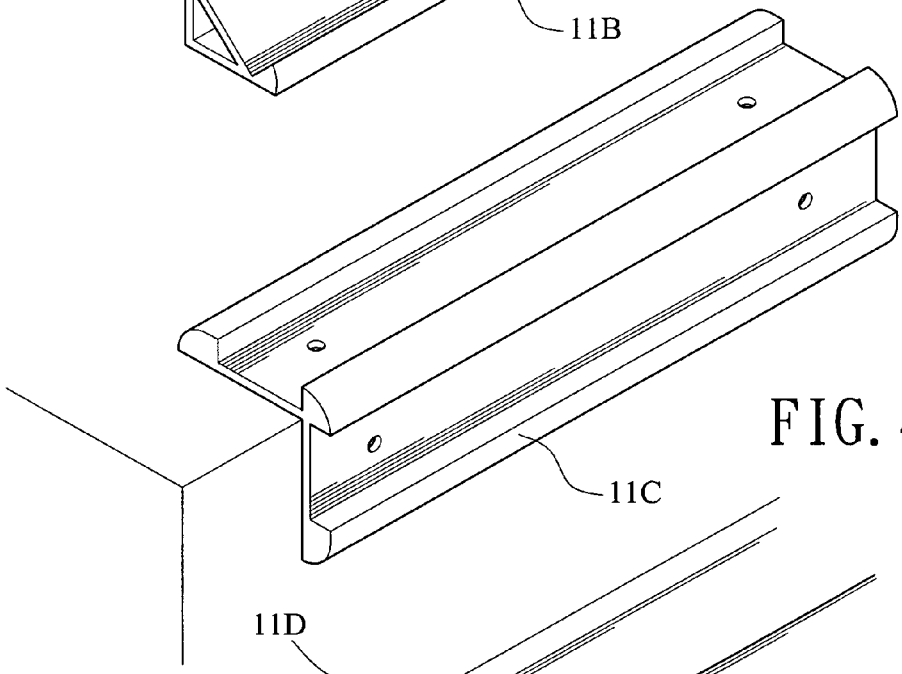
Figure 4D:
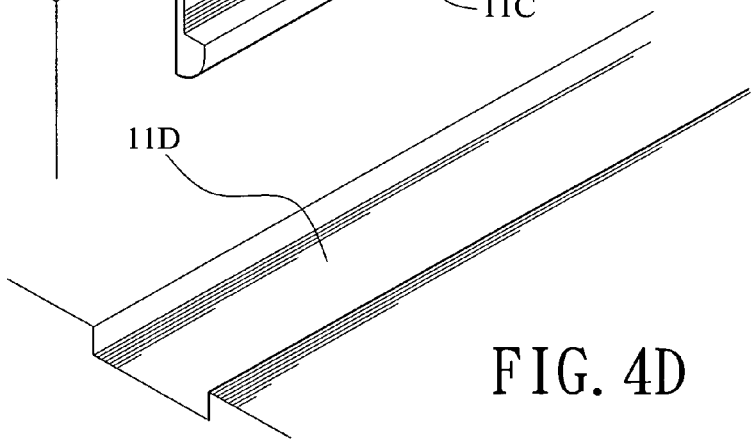

Referring to FIGS. 4A to 4D, the channel member 11 can be formed as one of a plurality of shapes depending on applications. In FIG. 4A, the channel member 11A has a section of U. In FIG. 4B, the channel member 11B has a section of triangle adapted to mount on a wall edge. In FIG. 4C, the channel member 11C has a section of inverted L adapted to mount on the nosing of stairs. In FIG. 4D, the channel member 11D has a section of U and is formed directly by digging a piece of timber or a construction material.

Figure 5A:
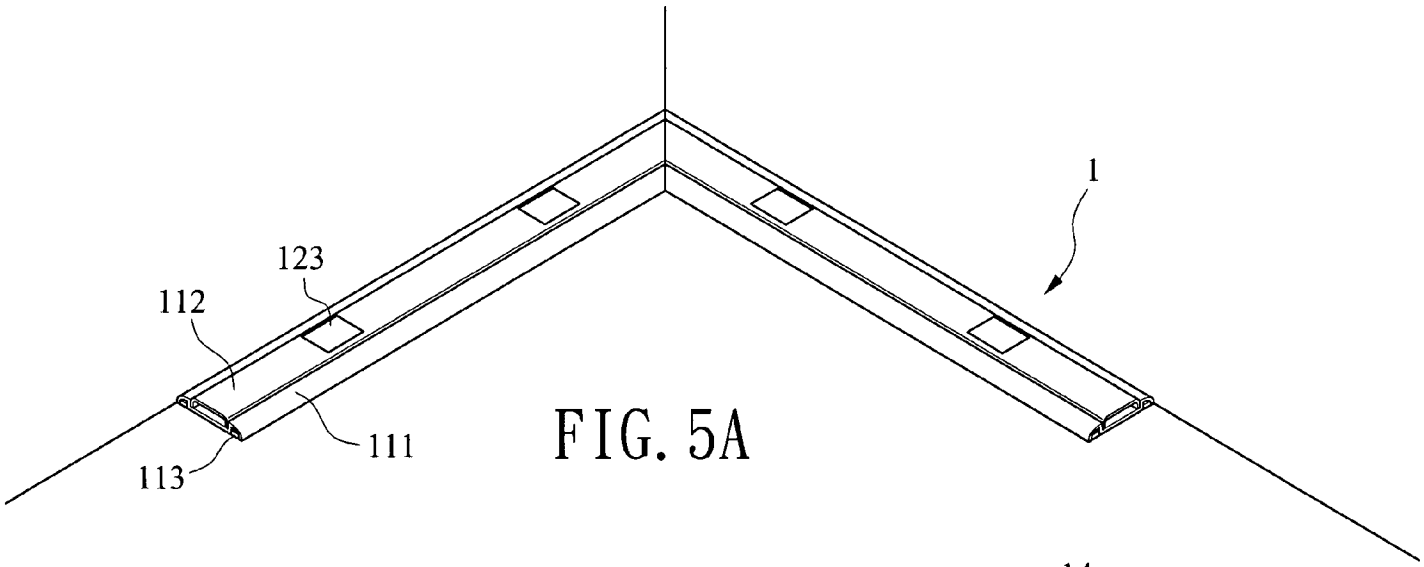
FIG. 5A is perspective view of the assembled device mounted on a wall corner.
Figure 5B:
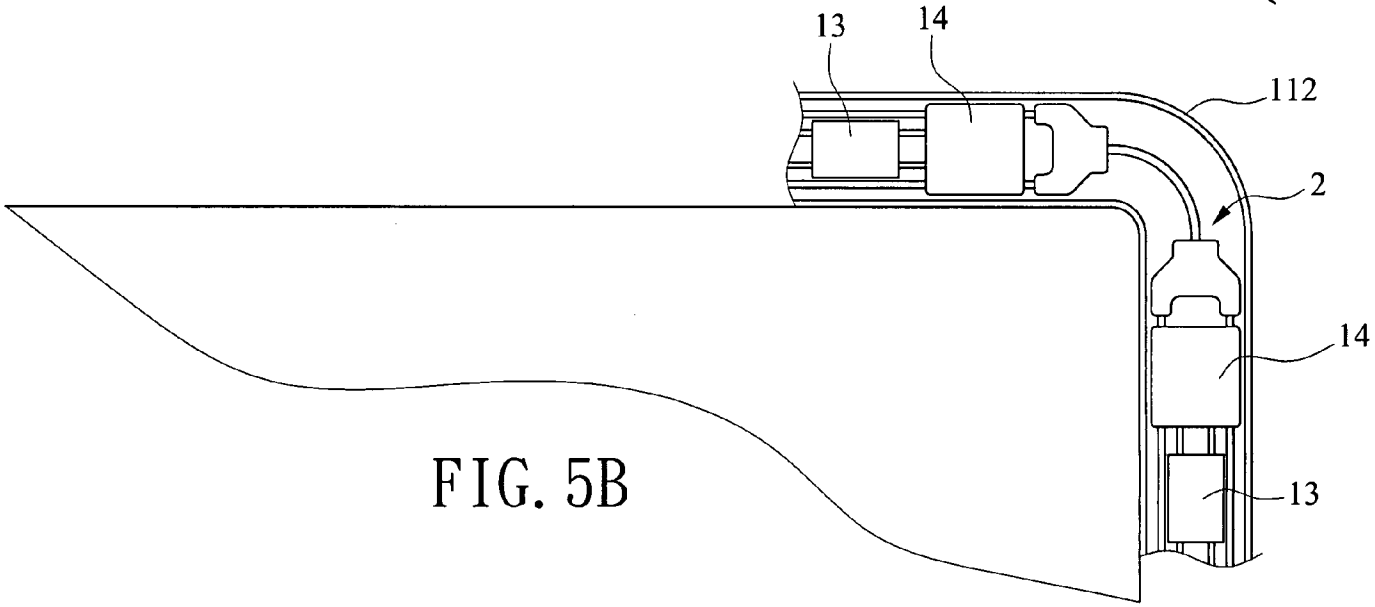
FIG. 5B is a top plan view of the assembled device mounted on another wall corner with the cover removed for illustration.

Referring to FIG. 5A, the assembled device is mounted on a wall corner. Referring to FIG. 5B, the assembled device is mounted on another wall corner. It is seen that the device is highly adaptable due to the provision of the flexible connector 2.

Referring to FIG. 6 again, a circuit diagram of the control circuit 14 is shown. The control circuit 14 comprises a processor unit 141, a battery current monitoring and charging circuit 142, and an alarm circuit 143.

Preferably, the processor unit 141 is implemented as a MCU (microcontroller unit) and is electrically connected to each of the first LED1 and the second LED2 of the light-emitting member 122 and the abnormal voltage detection circuit 126. The battery current monitoring and charging circuit 142 is electrically connected to the processor unit 141 and the power supply 13 respectively and is comprised of a plurality of resistors and conductors. In a normal state, the battery current monitoring and charging circuit 142 is adapted to monitor remaining current of the power supply 13 and is adapted to permit a charging of the power supply 13 if such condition arises.

The alarm circuit 143 is electrically connected to the abnormal voltage detection circuit 126 and is powered by the power supply 13. The alarm circuit 143 is electrically connected to an alarm generator 145 which is preferably an IC (integrated circuit) having a predetermined warning sound recorded therein. The alarm circuit 143 comprises two transistors Q2 and Q3 and a sound amplification member (e.g., speaker, buzzer, or the like) 146.

It is contemplated by the invention that the emergency exit indication and warning device can be customized as one having a desired length by assembling a plurality of indicator units 1. Also, it is highly adaptable so as to mount in a wall corner, on the nosing of stairs, on a floor, or the like. For example, in case of fire, a trapped person can either lower his or her body while running or walking or crawl so as to clearly see what is indicated by the device.

Operations of the invention will be described in detailed below. In a normal case each light-emitting member 122 of the indicator unit 1, having its first LED1 for visually indication and its second LED2 for monitoring remaining current of the power supply 13 and permitting a charging of the power supply 13 if such condition arises, is disabled. Also, the alarm circuit 143 is disabled. The battery current monitoring and charging circuit 142 is adapted to monitor remaining current of the power supply 13. The second LED2 is adapted to show the monitor result by emitting a corresponding color of light.

The processor unit 141 may activate a charging procedure for charging the power supply 13 if the amount of the remaining current stored in the power supply 13 is too low. Also, the processor unit 141 monitors remaining current of the power supply 13 in a predetermined period of time. Likewise, the second LED2 is adapted to show the monitor result by emitting a corresponding color of light. In the charging procedure, a constant current (e.g., 100 mA) is supplied to the power supply 13. The processor unit 141 will automatically stop the charging if the power supply 13 has been charged to a predetermined voltage (e.g., 4.2V). Thereafter, the control circuit 14 and the light-emitting members 122 enter into an off-but-ready mode for saving power.

In an abnormal case, for example in case of fire, external power supply is cut. The abnormal voltage detection circuit 126 can detect same in a very short period of time (e.g., 200 ms). At the same time, the abnormal voltage detection circuit 126 sends an activation signal to the alarm generator 145 and each of the light indicators 12 respectively. The enabled alarm generator 145 then activates the alarm circuit 143. As a result, the sound amplification member 146 makes a warning sound. Also, the first LED1 of the light-emitting member 122 emits light through the protection member 123 and the opening 115 for indication. Further, the power supply 13 supplies power to the alarm circuit 143 and the light indicators 12 respectively. In short, the alarm made by the emergency exit indication and warning device of the invention is carried out by both sound and light. Thus, even blind or deaf persons trapped in the scene can be informed of the danger. Further, they are guided by the device so as to successfully escape the scene. Note that the metal spacer members 113 together with the fireproof materials employed by the device can ensure that the device can operate normally for a sufficiently long period of time so as to help trapped people escape safely.

It is envisaged by the invention that the indicator unit 1 is comprised of a plurality of light indicators 12 mounted on a channel member 11 and is configured as an independent light and sound alarm. Further, each indicator unit 1 is equipped with an independent power supply 13. Thus, the operation of one indicator unit 1 is totally independent of the other indicator unit 1. Therefore, one malfunctioned indicator unit 1 will not adversely affect the operation of any other indicator unit 1.

Moreover, in addition to a waterproof treatment on the mounting of the cover 112 on the recess 114, the waterproof treatment is also done on all components concealed by the cover 112. As an end, the emergency exit indication and warning device is substantially waterproof.

While the invention herein disclosed has been described by means of specific embodiments, numerous modifications and variations could be made thereto by those skilled in the art without departing from the scope and spirit of the invention set forth in the claims.

What is claimed is:

1. A device for visually indicating and audibly warning people to escape from a building in case of emergency, comprising:

one or more thin indicator units (1) each including:

a channel member (11) including a base (111) and a cover (112) fitted on the base (111), the cover (112) including a plurality of openings (115);

a plurality of light indicators (12) electrically connected together and each including a housing (121) aligned with the opening (115), and a light-emitting member (122) mounted in the housing (121);

a control circuit (14) electrically connected to the light indicator (12) at one end of the indicator unit (1);

a first pair of first and second prongs (33 and 34) formed at one end of the control circuit (14);

a second pair of first and second prongs (33 and 34) formed at the other end of the light indicator (12) at the other end of the indicator unit (1); and a rechargeable power supply (13) mounted on the base (111) and electrically connected to the control circuit (14); and one or more electrical connectors (2) each including opposite first and second portions (21 and 22) electrically connected together, wherein the first portion (21) of one electrical connector (2) is adapted to electrically connect to the first pair of first and second prongs (33 and 34), and the second portion (22) of the other electrical connector (2) is adapted to electrically connect to the second pair of first and second prongs (33 and 34).

2. The device of claim 1, wherein the base (111) comprises a central lengthwise top recess (114) for mounting the light indicators (12), the power supply (13), and the control circuit (14) thereon.

3. The device of claim 2, further comprising two parallel spacer members (113) mounted in two sides of an underside of the base (111) respectively with the recess (114) formed therebetween.

4. The device of claim 1, wherein each light indicator (12) further comprises a transparent protection member (123) mounted on the housing (121).

5. The device of claim 4, wherein the protection member (123) is formed of a reinforced glass or an impact-proof material.

6. The device of claim 1, wherein the light-emitting member (122) comprises a plurality of LEDs and an abnormal voltage detection circuit (126).

7. The device of claim 6, wherein the LEDs comprise a first LED(1) for visually indication and at least one second LED (2) for monitoring remaining current of the power supply (13) and charging the power supply (13).

8. The device of claim 1, wherein the control circuit (14) comprises:

a processor unit (141) electrically connected to the adjacent light-emitting member (122) and an abnormal voltage detection circuit (126) respectively;

a battery current monitoring and charging circuit (142) electrically connected to the processor unit (141) and the power supply (13) respectively, the battery current monitoring and charging circuit (142) adapted to monitor remaining current of the power supply (13) and adapted to charge the power supply (13) if an amount of current in the power supply (13) is lower than a predetermined level, wherein the battery current monitoring and charging circuit (142) causes the control circuit (14) and each of light-emitting member (122) to enter into an off-but-ready mode after charging; and an alarm circuit (143) electrically connected to and enabled by the abnormal voltage detection circuit (126), wherein in response to power outage the abnormal voltage detection circuit (126) detects same and sends an activation signal to the power supply (13), the enabled power supply (13) supplies power to the alarm circuit (143) and each light indicator (12) respectively, the enabled alarm circuit (143) makes a warning sound, and each light indicator (12) emits light for indication.

9. The device of claim 8, wherein the processor unit (141) is a MCU (microcontroller unit).

10. The device of claim 8, wherein the alarm circuit (143) comprises an alarm generator (145), two transistors (Q2 and Q3), and a sound amplification member (146).

11. The device of claim 10, wherein the alarm generator (145) is an IC having a predetermined warning sound recorded therein.

12. The device of claim 10, wherein the sound amplification member (146) is a speaker or a buzzer.

13. The device of claim 1, wherein each of the first and second portions (21 and 22) comprises two receptacles (23 and 24) sealed by a waterproof membrane and adapted to receive the first and second prongs (33 and 34) of the same pair by inserting the first and second prongs (33 and 34) of the same pair through the membrane.

* * * * *